US009987742B1

(12) United States Patent
Mason et al.

(10) Patent No.: US 9,987,742 B1
(45) Date of Patent: Jun. 5, 2018

(54) DEVICE AND METHOD FOR POSITIONING HANGING OBJECTS

(71) Applicants: Kelly Mason, Austin, TX (US); Tom Mason, Columbus, OH (US)

(72) Inventors: Kelly Mason, Austin, TX (US); Tom Mason, Columbus, OH (US)

( * ) Notice: Subject to any disclaimer, the term of this patent is extended or adjusted under 35 U.S.C. 154(b) by 118 days.

(21) Appl. No.: 15/159,333

(22) Filed: May 19, 2016

(51) Int. Cl.
*B25H 7/04* (2006.01)
*A47G 1/20* (2006.01)

(52) U.S. Cl.
CPC ..... *B25H 7/045* (2013.01); *A47G 1/205* (2013.01)

(58) Field of Classification Search
CPC ..... A47G 1/205; B25H 7/045
USPC ..... 33/613, 371–373, 384, 388
See application file for complete search history.

(56) References Cited

U.S. PATENT DOCUMENTS 586,120 A 7/1897 Flynn
2,677,192 A * 5/1954 Anderson ..... G01C 15/00 33/372
2,952,431 A 9/1960 Pedley
4,100,681 A 7/1978 Hollander
4,162,056 A 7/1979 Moorhead
4,212,123 A 7/1980 Robin
4,530,482 A 7/1985 Berinson
4,597,554 A 7/1986 James
4,645,165 A 2/1987 Raap
4,679,328 A * 7/1987 Saad ..... B43L 13/004 33/447
4,964,219 A * 10/1990 Clark ..... G01C 9/24 33/384
4,972,590 A * 11/1990 Dentith ..... D04B 37/02 33/1 K
4,973,021 A * 11/1990 Schuite ..... A47G 1/1686 248/215
5,337,484 A * 8/1994 Cardon ..... B43L 13/201 33/41.2
5,443,238 A 8/1995 Mitchell
5,732,472 A * 3/1998 Praye ..... B25H 7/02 30/293
5,848,489 A 12/1998 Hartley et al.
5,927,675 A 7/1999 Kratish et al.
6,012,229 A 1/2000 Shiao
(Continued)

OTHER PUBLICATIONS

Innovative Tools, Inc., Hang it Perfect, specifications, retrieved from www.hangitperfect.com on Feb. 18, 2016.
(Continued)

*Primary Examiner* — Yaritza Guadalupe-McCall
(74) *Attorney, Agent, or Firm* — Thomas C. Saitta

(57) ABSTRACT

A system and method for positioning hanging objects includes a transfer sheet capable of being marked (e.g. paper) is releasably attached to a positioning member having a ledge that can be aligned with a top surface of an object being hung (e.g. picture); the transfer sheet is then marked (creating a transfer mark) at the location of the object's mounting portion (e.g. hook); the ledge is then positioned as desired (e.g. against a wall), and aligned using a built in level; a mark is made on the wall using the transfer mark (e.g. using a pencil through the transfer mark); a fastener (e.g. nail) is then fixed to the wall at the location of the mark; the object is then hung. Thus, the tedious and often erroneous process of calculating where the hole should be using measuring devices is eliminated.

19 Claims, 14 Drawing Sheets

(56) References Cited

U.S. PATENT DOCUMENTS

| | | | | |
|---|---|---|---|---|
| 6,119,999 | A | 9/2000 | Fleishman | |
| 6,205,669 | B1 * | 3/2001 | Sollars | A47G 1/205 33/371 |
| 6,357,716 | B1 | 3/2002 | Kratish et al. | |
| 6,409,140 | B1 | 6/2002 | Kratish et al. | |
| 6,471,175 | B1 | 10/2002 | Kratish et al. | |
| 7,226,032 | B2 * | 6/2007 | Schlais | A47G 1/205 248/466 |
| 7,555,842 | B1 * | 7/2009 | Asay | G01C 9/28 33/372 |
| 7,587,847 | B2 | 9/2009 | Lasher | |
| 8,087,180 | B1 | 1/2012 | Clayton | |
| 8,333,026 | B2 | 12/2012 | Southard | |
| 8,701,305 | B1 * | 4/2014 | Schoenebeck | G01C 9/28 33/347 |
| 8,898,945 | B2 | 12/2014 | Miller | |
| 8,899,541 | B2 * | 12/2014 | Bixler | A47G 1/164 248/295.11 |
| 9,733,077 | B2 * | 8/2017 | Swisher | G01C 9/02 |
| 2002/0066199 | A1 * | 6/2002 | Hanson | G01C 9/28 33/613 |
| 2004/0026593 | A1 | 2/2004 | Fay | |
| 2004/0177527 | A1 * | 9/2004 | Prevost | A47G 1/205 33/613 |
| 2005/0246930 | A1 | 11/2005 | Shaffer | |
| 2006/0168830 | A1 * | 8/2006 | Dallman | B42F 9/002 33/286 |
| 2006/0196069 | A1 * | 9/2006 | Groepper | A47G 1/205 33/613 |
| 2009/0139127 | A1 | 6/2009 | Southard | |
| 2011/0146091 | A1 * | 6/2011 | Spaulding | G01C 9/26 33/372 |
| 2013/0199068 | A1 | 8/2013 | Southard | |
| 2013/0283625 | A1 * | 10/2013 | Sullivan | G01C 9/28 33/371 |
| 2014/0075769 | A1 * | 3/2014 | Swisher | B44D 2/007 33/301 |
| 2014/0259718 | A1 | 9/2014 | Mehra et al. | |
| 2015/0201866 | A1 * | 7/2015 | Wojcieszak | A43D 1/02 33/512 |
| 2017/0008161 | A1 * | 1/2017 | Weitsman | B25H 7/045 |

OTHER PUBLICATIONS

Under the Roof Decorating, Hang & Level, about product section, retrieved from www.utrdecorating.com on Feb. 18, 2016.

Stanley, Laser line level, 20 ft Chalkline Self Leveling Line, product page screen shot, retrieved from www.stanleytools.com on Feb. 18, 2016.

* cited by examiner

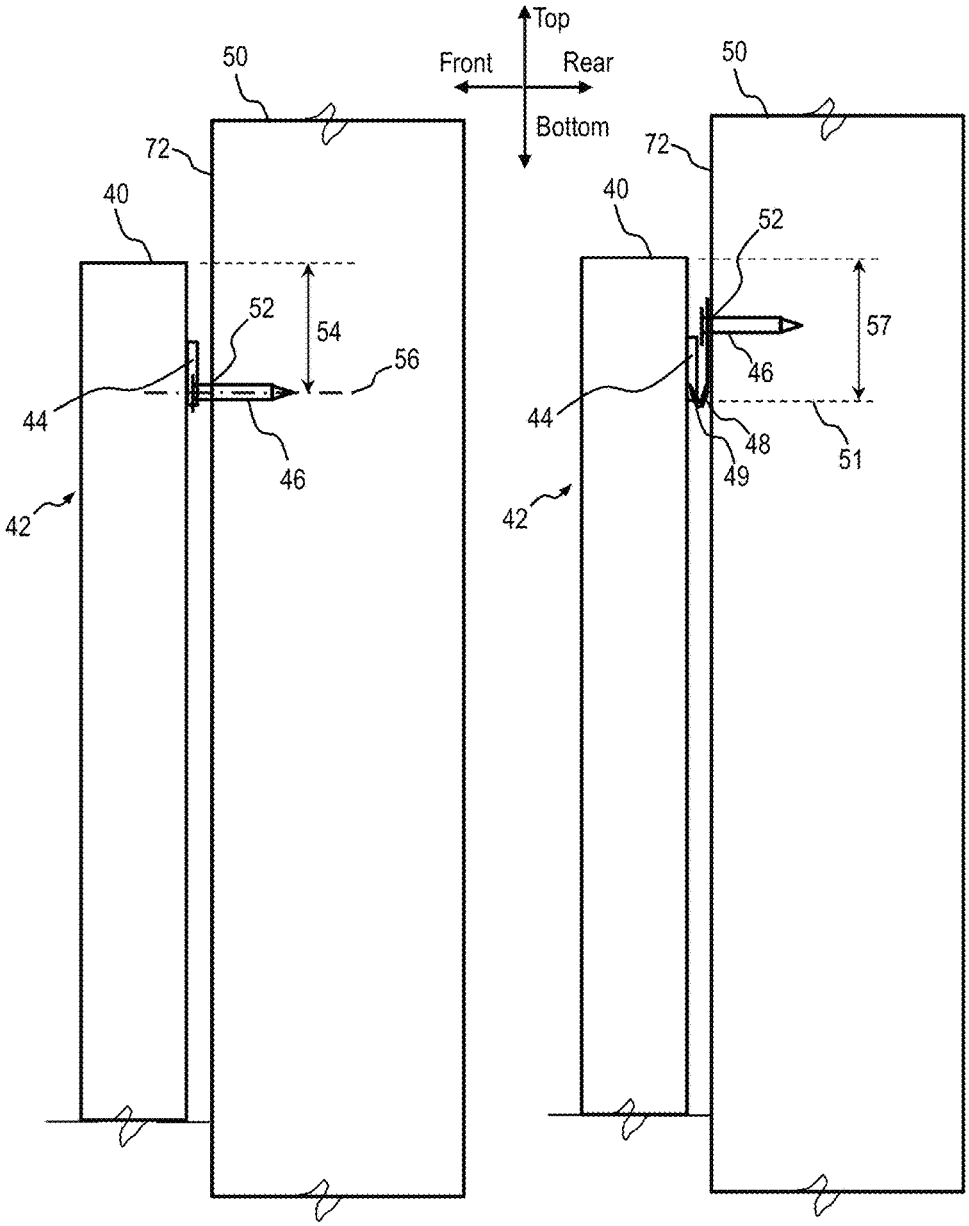
*Fig. 6A* *Fig. 6B*

DEVICE AND METHOD FOR POSITIONING HANGING OBJECTS

FIELD

The present invention relates generally to a device and method for positioning mountable objects on a wall, in particular to a device having a transfer sheet used to mark fastener or mount support coupling locations for the object and for aligning in a level position against the wall at predetermined coordinates to allow transfer of the marked fastener or mount support coupling locations upon the wall.

BACKGROUND

When users are decorating a space, they typically choose to mount various hanging objects from walls or other planar structures. A wide variety of hanging objects may be wall-mounted, which may include, for example, photos, pictures, mirrors, screens, signs, clocks or sculptures. These hanging objects may include various pre-attached rear mounts, such as rings, loops, wires, hooks or sawtooth mounts. Some small or light-weight hanging objects may be hung directly to a wall via wall fasteners coupled to their rear mounts. Wall fasteners may include various anchors, nails, screws or pins, and typically require that one or more holes be created at predetermined coordinates in the wall. Large or heavy-weight hanging objects may require additional intermediate mount supports such as hooks or hangers to be coupled to their rear mounting systems at one end and then coupled to wall fasteners at the other end. The process for measuring and positioning wall marks for such holes can be very time consuming and frustrating for the user.

Existing tools or template systems have been developed for creating wall marks or holes or positioning of fasteners for hanging objects. Such devices tend to be complex, hard to use, and time consuming for the user. Some existing marking tools have built-in hangers with movable indention pins for marking the wall. These types of tools are intended for use primarily with wire mounts and require additional measuring tools for positioning the marks relative to adjacent objects. Such tools lack the flexibility for quick use with all types of rear mounts, including various hangers. Additionally, some known tools are heavy and difficult for a single user to hold up and operate against the desired wall surface.

There remains a need for a light-weight device that enables accurate transfer of fastener geometric locations without measurement, while remaining simple, quick and easy to use. The present invention incorporates a transfer sheet used to mark fastener geometric locations relative to the object being hung (e.g. relative to the top edge of a picture frame), without having to measure distances. Further, such device may be used for aligning in a level position against the wall at predetermined coordinates to allow transfer of the marked fastener locations upon the wall. As such, the fasteners installed at the transferred fastener locations will allow for accurate positioning of the hanging objects against the wall without measuring.

SUMMARY

In one embodiment, a thin sheet capable of being marked and/or punctured (e.g. tracing paper) is releasably attached to a positioning member having a ledge that can be aligned with a surface (e.g. top surface) of the object being hung (e.g. picture); the sheet is then marked or punctured (creating a transfer mark) at the location of the object's required fastener or hanger locations (e.g. fastener); the device is then positioned as desired (e.g. against a wall), and aligned using a built in level; a mark is made on the wall using the transfer mark (e.g. using a pencil through the transfer mark); a fastener (e.g. nail) is then fixed to the wall at the location of the mark; the object is then hung. Thus, the tedious and often erroneous process of calculating where the hole should be using measuring devices is eliminated.

In one embodiment, a method for positioning hanging objects includes obtaining a device having a positioning member releasably connected to a transfer sheet. The positioning member includes a ledge positioned perpendicular (as viewed from the side) to the transfer sheet. The positioning member further includes a built-in level, positioning system and laser system. The method includes obtaining an object and a fastener. The object includes a rear mount configured for coupling to the fastener. The fastener is configured to be secured to a planar structure (e.g., a wall) by insertion into a hole created at predetermined coordinates in the planar structure. The method includes engaging the ledge against a top surface of the object such that the transfer sheet covers the rear mount or mounts. The method includes marking the rear side of the transfer sheet at the location aligning with intended position of the fastener to create a transfer mark. The method includes placing the rear of the device against a front surface of the planar structure and utilizing one or more of the level, positioning system and laser system to position the device at predetermined coordinates on the planar structure. The method includes inserting a marking tool on the front side of the transfer sheet through the transfer mark and creating a mark on the front surface of the planar structure. Thus, after moving the device away from the wall, installing a hole at the mark, and installing the fastener in the hole, the object may be mounted against the planar structure by coupling the rear mount to the installed fastener.

BRIEF DESCRIPTION OF THE DRAWINGS

Further features of the present invention will become apparent to those skilled in the art to which the present invention relates from reading the following specification with reference to the accompanying drawings, in which:

FIG. 6A is a side view in section of the object of FIG. 4 mounted to a planar structure by the rear mount coupled to a fastener;

FIG. 6B is a side view in section of the object of FIG. 4 mounted to a planar structure by the rear mount coupled to a mount support coupled to a fastener;

DETAILED DESCRIPTION

Figure 1:
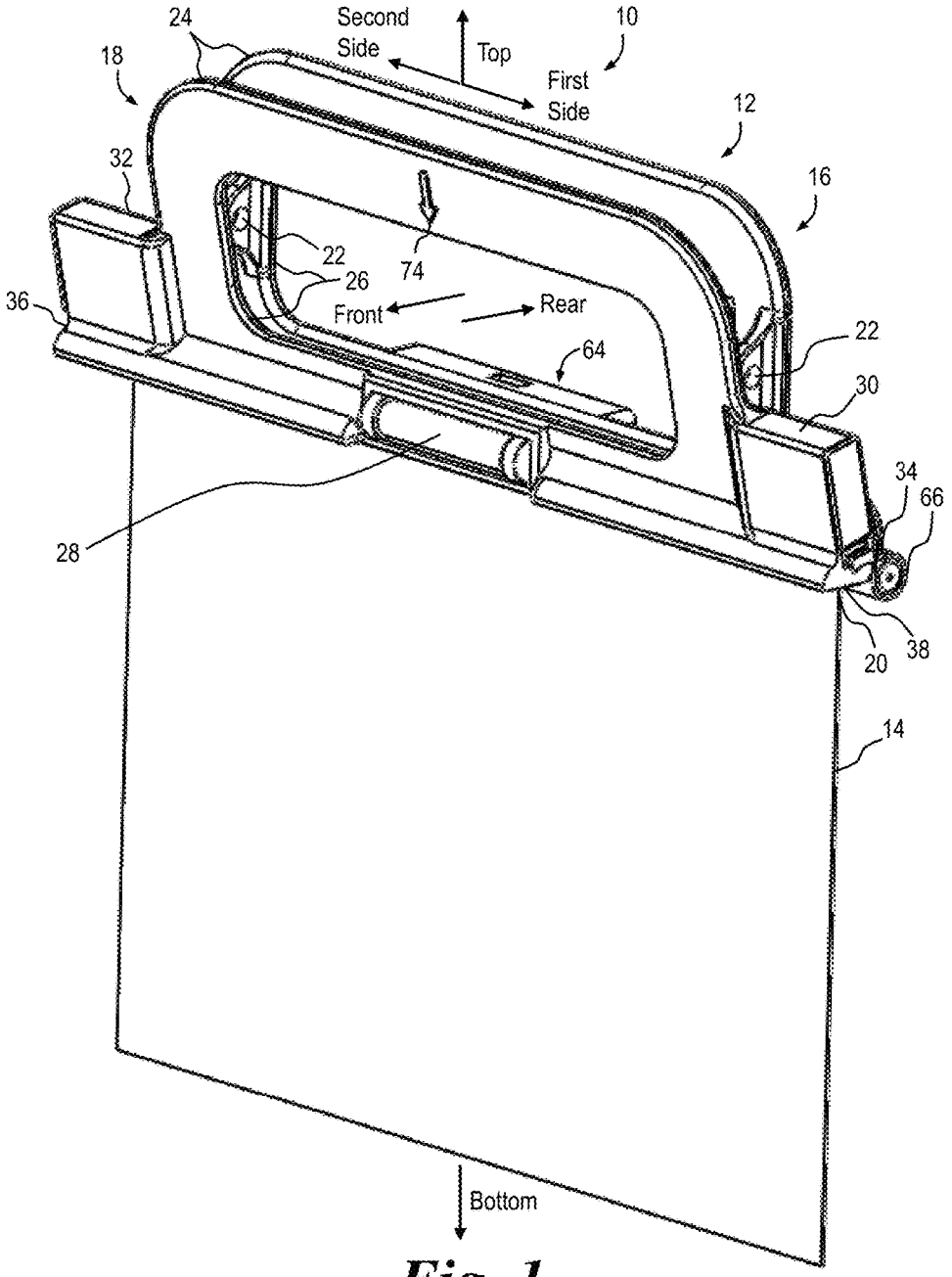
FIG. 1 is a front perspective view of a device according to an embodiment of the present invention.
Figure 2:
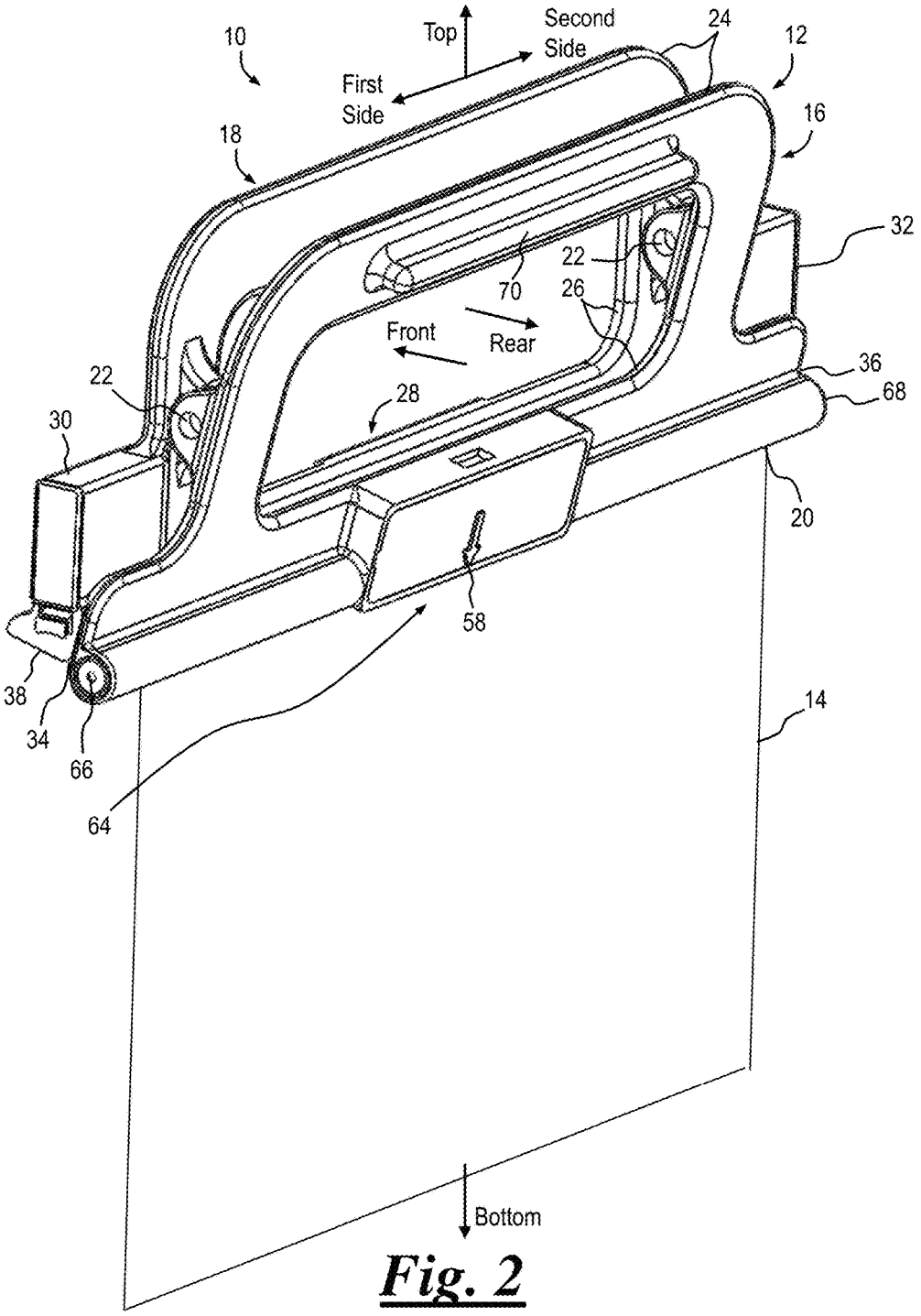
FIG. 2 is a rear perspective view of the device of FIG. 1.
Figure 3:
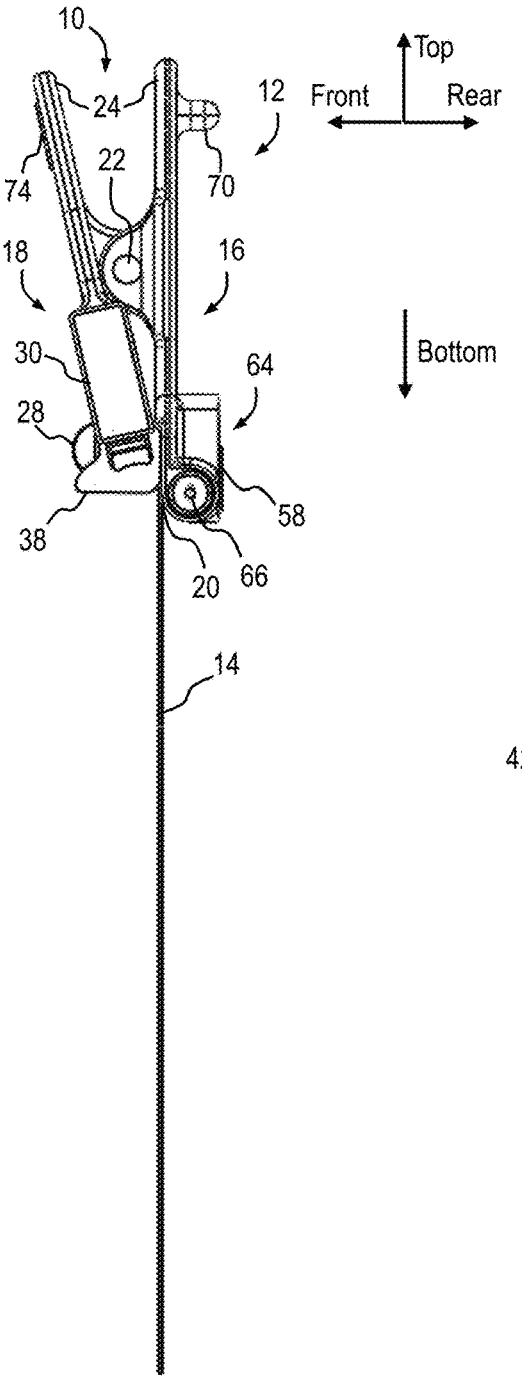
FIG. 3 is a first side elevation view of the device of FIG. 1.
Figure 4:
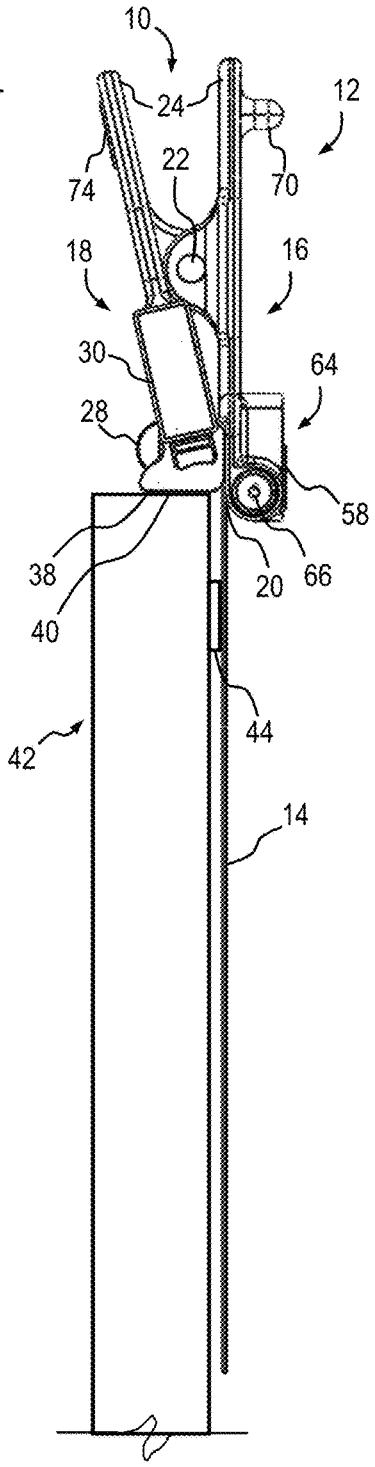
FIG. 4 is the device of FIG. 3 shown engaging the top portion of an object for hanging.
Figure 5:
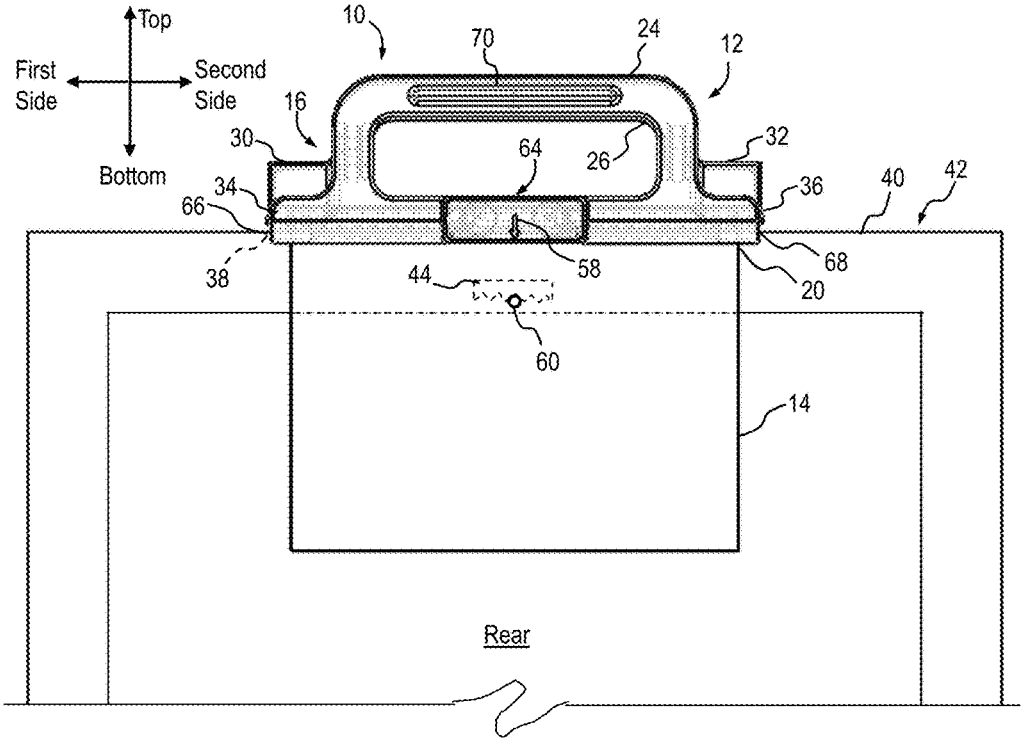
FIG. 5 is a rear view of the device of FIG. 3 shown in template mode engaging the top portion of an object for hanging.

In the discussion that follows, like reference numerals are used to refer to like structures and elements in the various figures and embodiments. Furthermore, the elements in the various figures are not necessarily to scale.

The general arrangement of a device 10 for positioning hanging objects is shown in FIGS. 1 through 10 according to an embodiment of the present invention. Device 10 includes a positioning member 12 that is releasably connectable (i.e. selectably connected) to one or more transfer sheets 14. Positioning member 12 includes a rear base 16 rotatably coupled to a front guide 18. Rear base 16 is biased in a normally closed position against front guide 18 in order to secure a proximal edge 20 of transfer sheet 14.

Device 10 includes a pair of spaced-apart hinge clamps 22 intermediate and connected to rear base 16 and front guide 18. Hinge clamps 22 enable front guide 18 to rotate from a normally closed to a normally open position, relative to rear base 16, for selectable securing of transfer sheet 14 between bottom ends of the front guide and the rear base. Hinge clamps 22 also act to bias rear base 16 against front guide 18, such that the bottom ends of the rear base and front guide engage against proximal edge 20 of transfer sheet 14 in the closed position. The biasing function is accomplished by a spring-like characteristic realized by springs or the material properties (e.g. elasticity) of clamps 22.

Top sections of front guide 18 and rear base 16 include generally U-shaped handle portions 24 having apertures 26. Handle portions 24 provide a hand-hold for the user to activate and de-activate hinge clamps 22, to allow for moving or securing transfer sheet 14. Handle portions 24 further allow the user to position, transport and support device 10 during use.

During use, device 10 is used in two main modes, template mode and transfer mode. In template mode, device 10 engages an object intended for hanging to establish the geometric relationship of the required fastener or mount support coupling locations relative to an edge of the object. In transfer mode, device 10 engages a planar structure in the desired position so the geometric relationship of the required fasteners or mount support coupling locations may be transferred by marking onto the planar structure.

Front guide 18 includes a built-in level 28 configured to provide an indication of the front side of device 10 that the device is being positioned in a level horizontal position. In one embodiment, level 28 comprises a bubble (aka spirit) level.

Front guide 18 further includes a pair of opposing positioning systems 30, 32 to indicate horizontal or lateral distance from a first side 34 or second side 36, respectively, to an adjacent point or object. Although shown as a retractable tape measure, positioning systems 30, 32 may be any suitable distance measuring system, including electronic (e.g. ultrasonic, laser) distance indicators. Positioning systems 30, 32 are preferably built-in as an inherent part of device 10 to allow the user to measure distances to and from other adjacent objects more quickly and easily with the dual side functionality.

Front guide 18 includes a ledge 38 on the bottom end positioned approximately perpendicular (as viewed from the side) to transfer sheet 14. Ledge 38 is configured to abut a top surface 40 of an object 42 for hanging (see also FIGS. 4 and 5). Ledge 38 serves as the device reference point for establishing the geometric relationships during template mode. Object 42 may be any object suitable for hanging, such as, without limitation, photos, pictures, mirrors, screens, signs, clocks, art, or sculptures. Object 42 may include an inner member having a perimeter framing of wood, plastic or other suitable material. Object 42 includes one or more pre-attached rear mounts 44 configured to be selectably coupled to a fastener 46 (see FIG. 6A). Rear mount 44 is shown as a sawtooth type bracket, but may be any suitable mount configured to couple with a fastener or mount support, such as, without limitation, rings, loops, wires, or hooks. Fastener 46 may be any suitable fastener, such as, without limitation, nails, screws, bolts, anchors, suction cups, or pins.

In some applications, a mount support 48 is selectably coupled intermediate rear mount 44 and fastener 46 (see FIG. 6B). Mount support 48 may be any suitable mount support such as, without limitation, hooks or hangers. In some embodiments, object 42 may use hook and loop type fasteners or adhesive systems for mounting. Referring to FIGS. 6A and 6B, fastener 46 is configured to support the weight of object 42 for mounting to a planar structure 50. Planar structure 50 may be any planar structure suitable for supporting hanging objects, such as, without limitation, walls, doors, windows, cabinets, curtains, panels, columns or cork boards.

Referring again to FIG. 6B, fastener 46 is selectably coupled at a proximal end of mount support 48 and rear mount 44 is selectably coupled at a distal end of the mount support. Mount support 48 engages rear mount 44 at a coupling portion 49 at the distal end of the mount support. A horizontal axis of the engaging intersection of rear mount 44 and coupling portion 49 of mount support 48 creates a coupling intersection line 51 which is approximately parallel to top surface 40.

Fastener 46 is configured to be secured to a planar structure 50 by insertion into a hole 52 created at predetermined coordinates in the planar structure. In applications where fastener 46 couples directly to rear mount 44 (as in FIG. 6A), (hereafter referred to as "direct coupling"), there is a pre-determined first vertical distance 54 from top surface 40 to a horizontal centerline 56 through hole 52. In applications where fastener 46 couples indirectly to rear mount 44 (e.g. via mount support 48, as shown in FIG. 6B), (hereafter referred to as "indirect coupling") there is a pre-determined first vertical offset distance 57 from top surface 40 to coupling intersection line 51. The mark is made on the transfer sheet at 57, but hole 52 is offset and ascertained by aligning fastener 46 with the mark and with front surface 72 of planar structure 50.

Referring again to FIG. 5, rear base 16 includes an alignment arrow 58 to provide a visual indication on the rear side of device 10 of the horizontal center of the device in applications with an object having a single, centrally located rear mount 44. In use in such applications, in template mode, device 10 may be placed on top of top surface 40 such that alignment arrow 58 aligns with rear mount 44 and the front side of transfer sheet 14 fully extends across or covers rear mount 44. For objects with dual rear mounts 44, the user would place device 10 such that the front side of transfer sheet 14 covers both rear mounts. In direct coupling applications, the user may then utilize a suitable marking member 59, such as, without limitation, a pencil, pen, marker, stylus, pin or fastener 46, to lightly mark or puncture the rear side of transfer sheet 14 at the locations aligning with each centerline 56 (for positioning the mounting location of fastener 46), creating transfer marks 60 (see also FIG. 7A).

Transfer sheet 14 may be formed of any suitable transparent, semi-transparent or translucent material such as tracing paper or vellum, for example. As an option, transfer sheet 14 may include transfer media incorporated onto the transfer sheet. Such transfer media may be configured to create a visual mark on the front side of transfer sheet 14 once pressure is applied by marking member 59 on the rear side of the transfer sheet when used during template mode. In addition, such transfer media may be configured to create a visual mark on the surface of planar structure 50 once pressure is applied by marking member 59 on the front side of transfer sheet 14 when used during transfer mode.

Figures 7A, 7B:
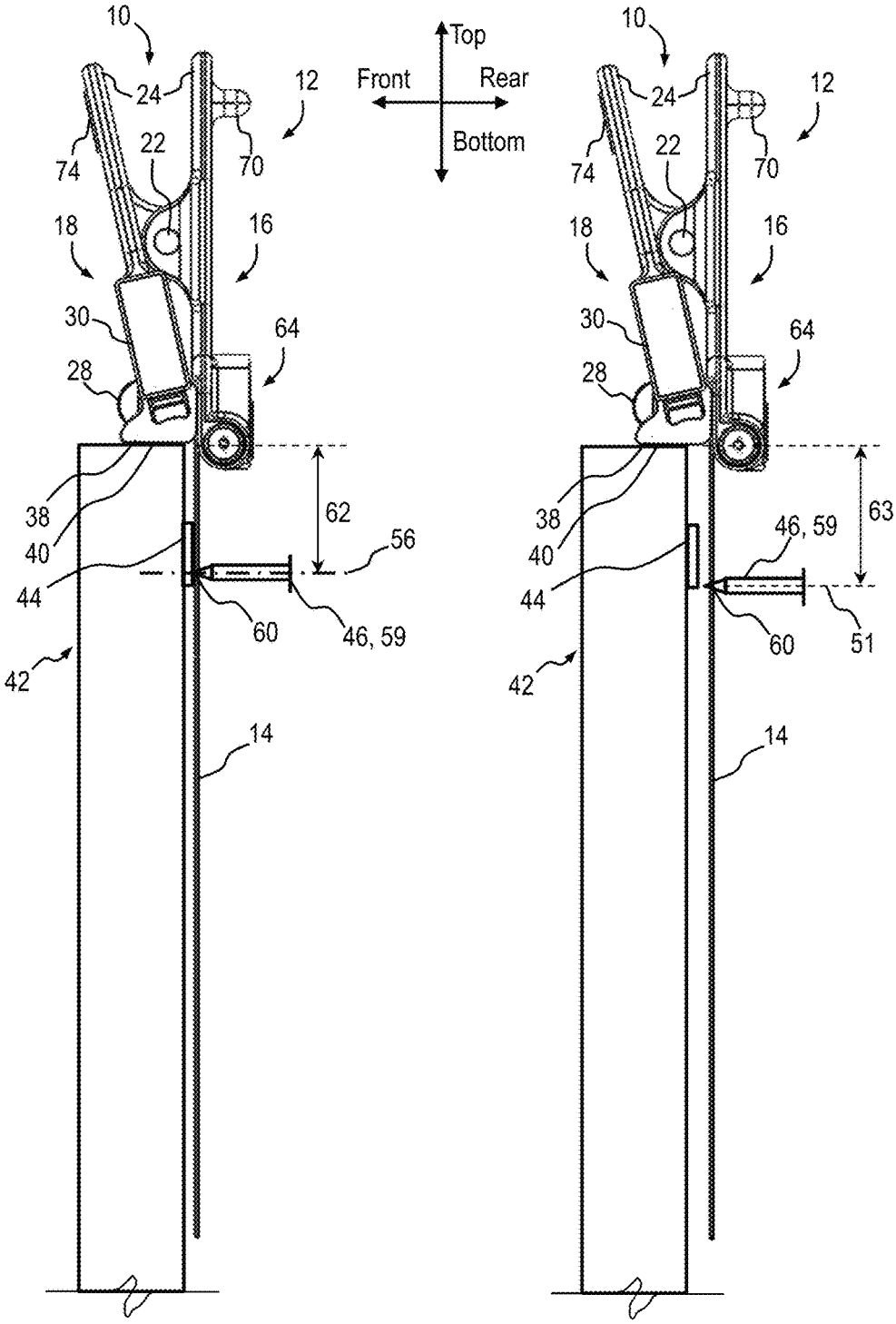
FIG. 7A is a side elevation view of the device and object of FIG. 4 showing a fastener used to create a transfer mark on the transfer sheet.
FIG. 7B is a side elevation view of the device and object of FIG. 4 showing a fastener used to create a transfer mark on the transfer sheet where a mount support is used.

Referring to FIG. 7A, in direct coupling applications, while keeping ledge 38 in engagement with top surface 40, the user utilizes marking member 59, shown here as fastener 46, to lightly mark or puncture the rear side of transfer sheet 14 at the locations aligning with each centerline 56 (for positioning the mounting location of fastener 46), creating transfer marks 60. Through the creation of transfer marks 60 a second vertical distance 62 is formed on device 10 (specifically, transfer sheet 14) from ledge 38 to the centerline of transfer marks 60. The location of centerline 56 is independent of the type or diameter of the fastener. Second vertical distance 62 is approximately equal to first vertical distance 54. Thus, the geometrical relationship between top surface 40 and centerlines 56 is then easily directly transferred to device 10 via ledge 38 and transfer marks 60.

Referring to FIG. 7B, in indirect coupling applications, while keeping ledge 38 in engagement with top surface 40, the user utilizes marking member 59, shown here as fastener 46, to lightly mark or puncture the rear side of transfer sheet 14 at the locations aligning with each coupling intersection line 51 (for positioning the coupling intersection location of coupling portion 49 of mount support 48), creating transfer marks 60. Through the creation of transfer marks 60 a second vertical offset distance 63 is formed on device 10 from ledge 38 to the centerline of transfer marks 60. The location of coupling intersection line 51 is independent of the type or thickness of the mount support. Second vertical offset distance 63 is approximately equal to first vertical offset distance 57. Thus, the geometrical relationship between top surface 40 and coupling intersection lines 51 is then easily directly transferred to device 10 via ledge 38 and transfer marks 60.

Figure 8B:
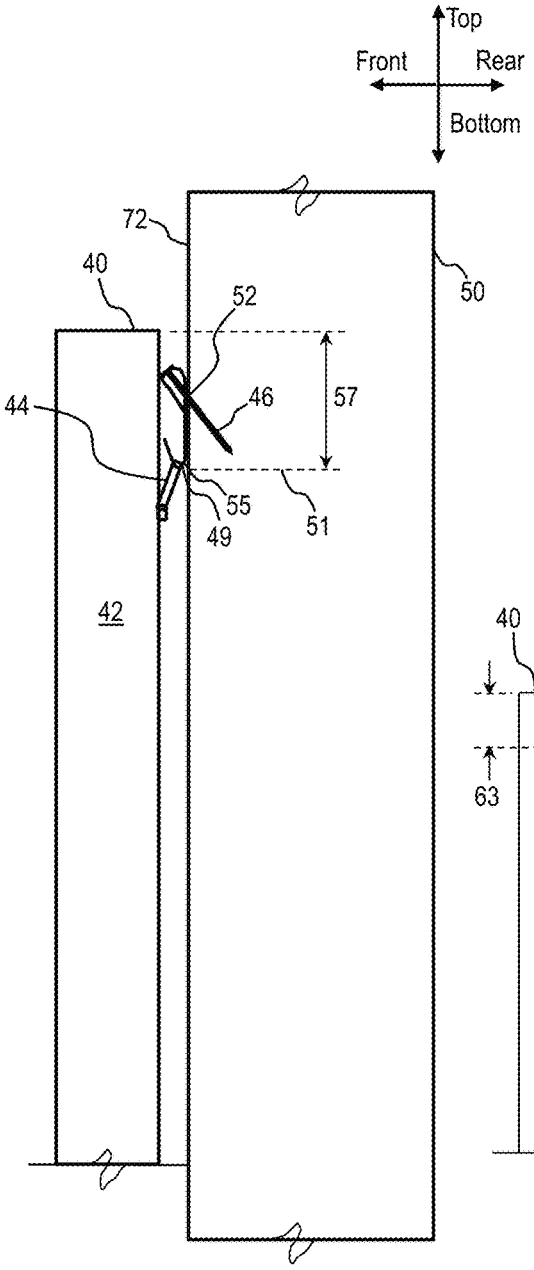
FIG. 8B is a side elevation view of an object mounted to a planar structure by a rear mount ring coupled to the hanger of FIG. 8A.
Figure 8A:
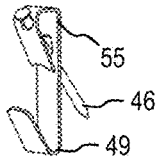
FIG. 8A is a front perspective view of a hanger with angled fastener.

Referring to FIGS. 8A and 8B, a common type of mount support for indirect coupling such as hanger 55 includes two openings so the matching fastener 46 is inserted into the wall or front surface 72 of planar structure 50 at an angle. Hanger 55 engages rear mount 44 at coupling portion 49 at the distal end of the mount support. The axis of the engaging intersection of rear mount 44 and coupling portion 49 of hanger 55 creates the coupling intersection line 51. Regardless of the angled fastener, when hanger 55 is coupled to rear mount 44 (shown as a rotatable ring) there is the pre-determined first vertical offset distance 57 from top surface 40 to coupling intersection line 51.

Figure 8C:
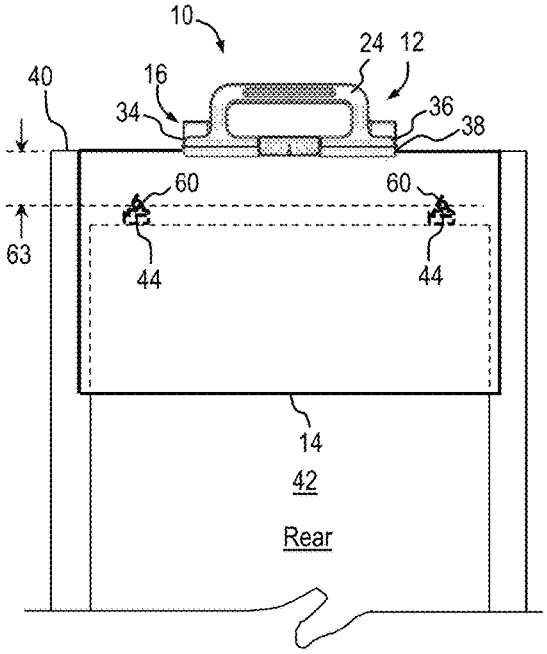
FIG. 8C is a rear view of the device of FIG. 3 shown in template mode engaging the top portion of the object and hanger of FIG. 8B.

The indirect coupling application shown in FIG. 8C shows device 10 applied in template mode with transfer sheet 14 extended across two rear mounts 44 that are intended for coupling to corresponding hangers 55. While keeping ledge 38 in engagement with top surface 40, the user utilizes marking member 59 (not shown) to lightly mark or puncture the rear side of transfer sheet 14 at the locations aligning with coupling intersection line 51 (for positioning the coupling intersection location of coupling portion 49 of hangers 55), creating transfer marks 60. Through the creation of transfer marks 60 a second vertical offset distance 63 is formed on device 10 from ledge 38 to the centerline of transfer marks 60. Second vertical offset distance 63 is approximately equal to first vertical offset distance 57. Thus, the geometrical relationship between top surface 40 and coupling intersection lines 51 is then easily directly transferred to device 10 via ledge 38 and transfer marks 60.

Figure 14:
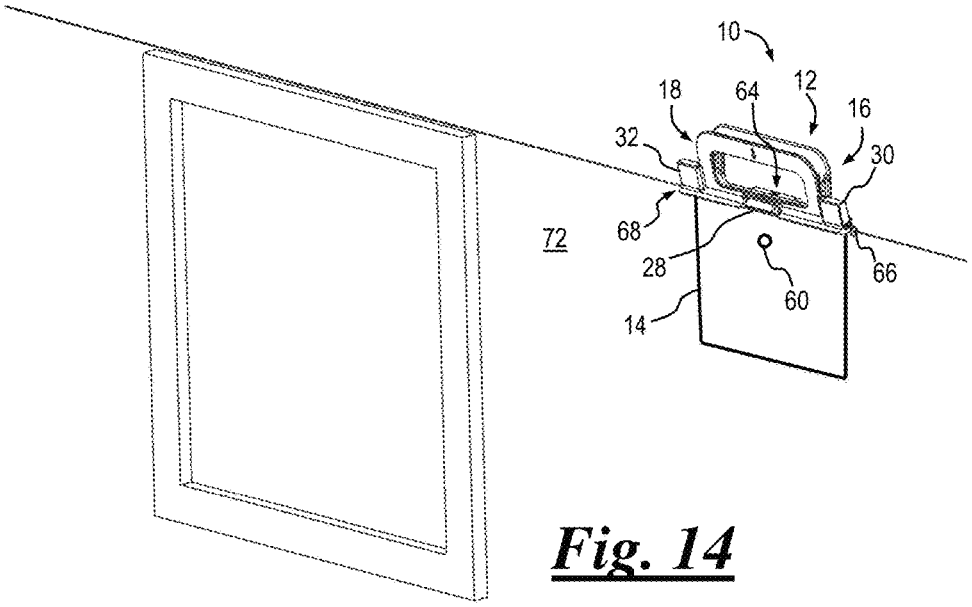
FIG. 14 is a front perspective view of the device of FIG. 5 shown in transfer mode with the laser emitters activated.
Figure 15:
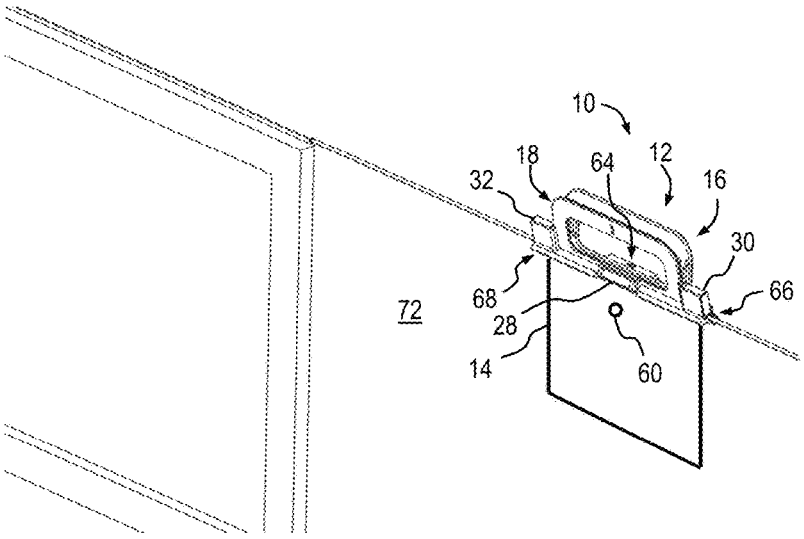
FIG. 15 is the device of FIG. 12 shown with the positioning system activated.

Referring to FIGS. 2, 4, 5, 9 and 10, rear base 16 includes a laser system 64 having a pair of opposing laser emitters 66, 68 to project a level light beam from first side 34 or second side 36, respectively, to an adjacent object (see also FIGS. 14 and 15). Laser emitters 66, 68 are located on device 10 such that the centerline of the light beam is at the same vertical level as ledge 38. Thus, used in conjunction with level 28, laser system 64 may be used to align ledge 38 (and thus, top surface 40 of an object to be hung) with an adjacent top surface 40 of an adjacent hanging object, positioning all the top surfaces at the same horizontal level. Laser system 64 is preferably built-in to device 10 to allow the user to position the fastener locations more quickly and easily with the dual side functionality. Laser system 64 may be battery powered and may include a switch to activate either of both laser emitters 66, 68 (see FIG. 10).

Referring to FIGS. 2 through 4, 11 and 12, rear base 16 also includes a stabilizer bar 70 to maintain the vertical plane of the rear base substantially parallel to a front surface 72 of planar structure 50 in use. In use in the transfer mode, device 10 may be placed with rear base 16 against front surface 72 of planar structure 50 (see FIGS. 11 and 12).

Figure 9:
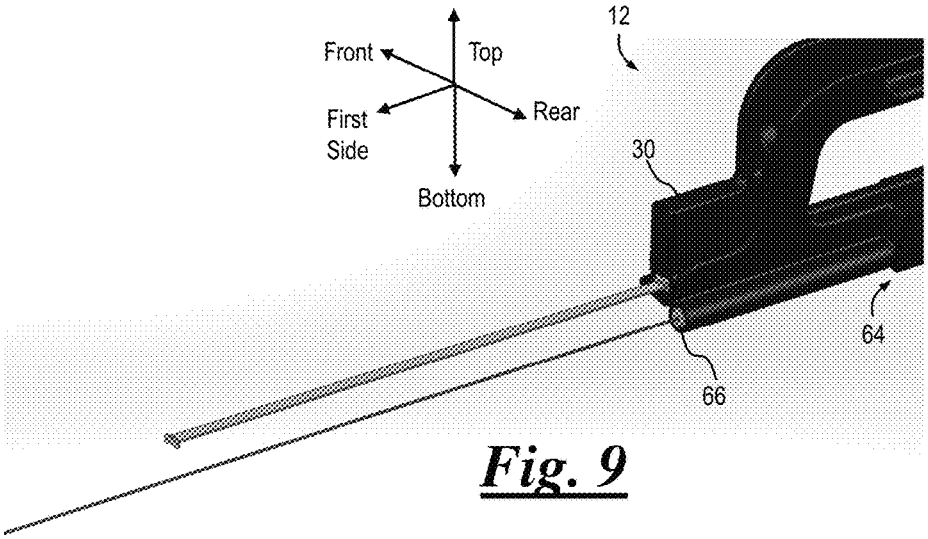
FIG. 9 is a partial rear perspective view of the positioning member of FIG. 3 showing the positioning system and laser emitter activated.
Figure 10:
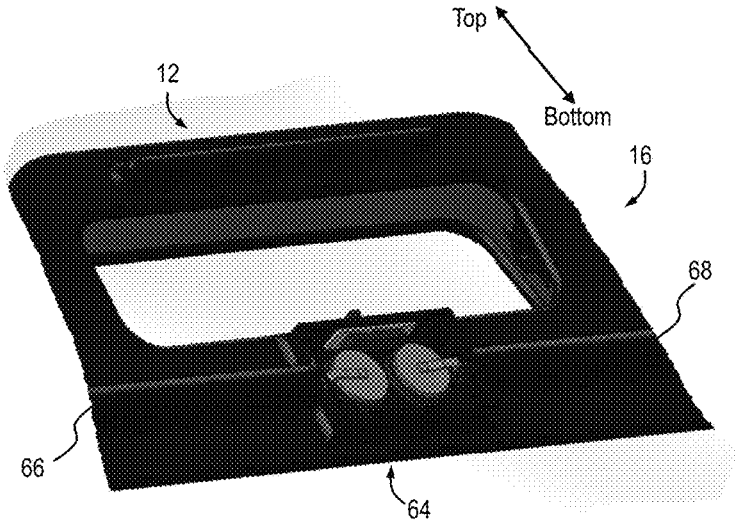
FIG. 10 is a partial rear perspective view of the positioning member of FIG. 9 with the laser system cover removed to show the batteries.
Figure 11:
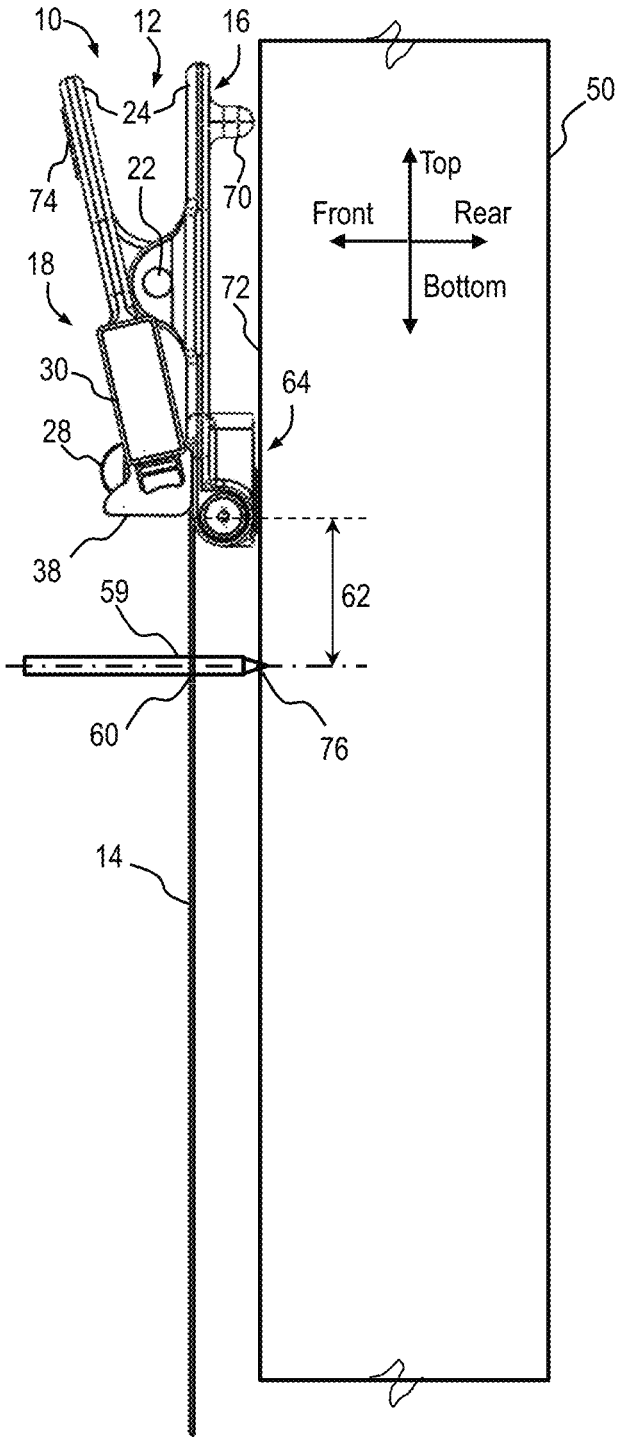
FIG. 11 is a side elevation view of the device of FIG. 5 shown in transfer mode applying a mark on a planar structure for a direct coupling application.
Figure 12:
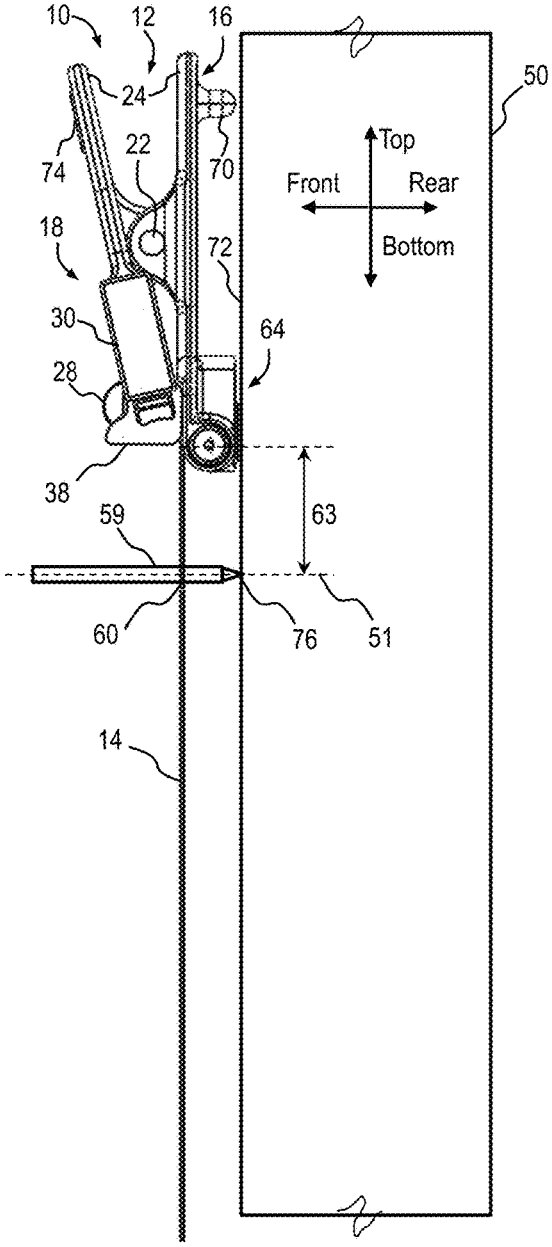
FIG. 12 is a side elevation view of the device of FIG. 8C shown in transfer mode applying a mark on a planar structure for an indirect coupling application.

Device 10 may be leveled with level 28, and positioning systems 30, 32 used where needed to locate the device horizontally (see FIGS. 9, 14 and 15). Referring back to FIGS. 1 and 3, front guide 18 also includes a reference arrow 74 to provide a visual indication on the front side of device 10 of the horizontal center of the device. Where needed, laser system 64 may then be used to locate the device vertically. As shown in FIGS. 11 and 12, the user may then utilize marking member 59 inserted on the front side of transfer sheet 14 through transfer marks 60 to create marks 76 on front surface 72 of planar structure 50. In direct coupling applications, the device 10 may then be removed from the area where marks 76 were created, and the user may install holes 52 for or with fasteners 46 that correspond to each of the marks. Once all fasteners 46 are installed, the rear mounts 44 may then be selectably coupled directly to the fasteners, thus mounting object 42 to planar structure 50. Transfer sheet 14 may then be removed from device 10 and replaced, or removed, rotated and reinserted to allow reuse for positioning another hanging object.

Figure 13:
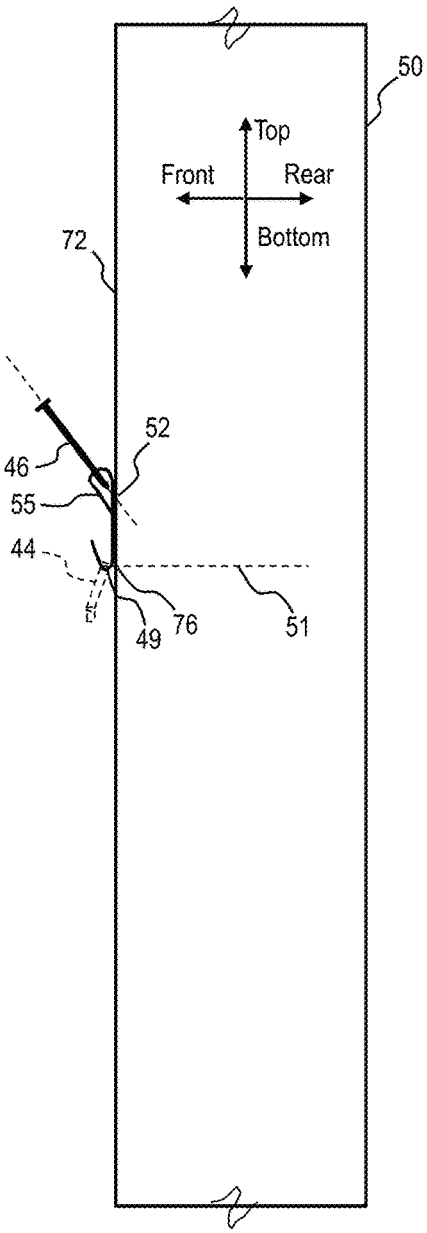
FIG. 13 is the side elevation view of the marked planar structure of FIG. 12 shown installing a hanger with fastener for an indirect coupling application.

Referring to FIG. 13, in indirect coupling applications, the user may install corresponding mount supports 48, shown here as hanger 55, to front surface 72. The user would position coupling portion 49 of mount support 48 adjacent front surface 72 to be aligned with mark 76. While holding mount support 48 securely, the user may then install hanger 55 to planar structure 50 via fastener 46 via hole 52. Once all fasteners 46 are installed, the rear mounts 44 may then be selectably coupled to hangers 55, thus mounting object 42 to planar structure 50 (see FIG. 8B).

Figure 16:
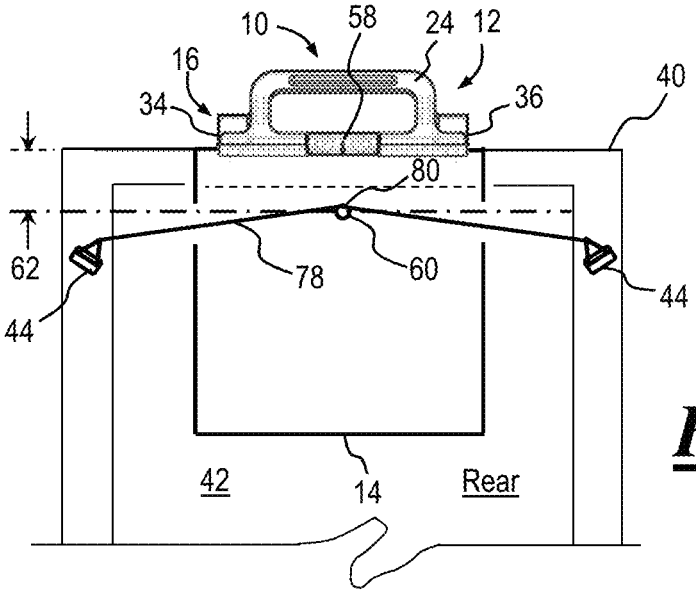
FIG. 16 is the rear view of the device of FIG. 3 used with an object having a wire between rear mounts.
Figure 17:
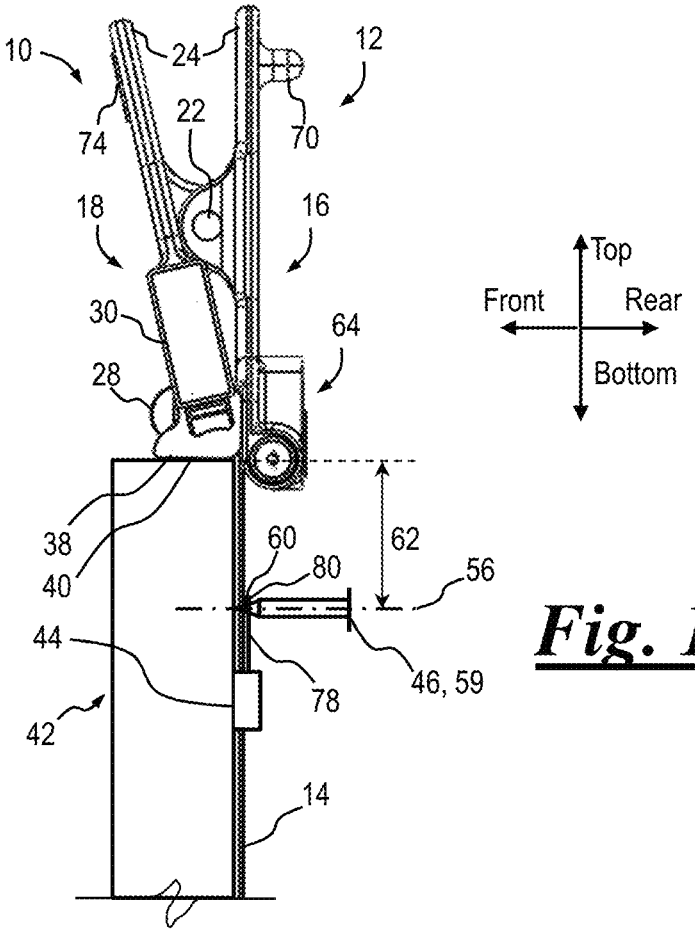
FIG. 17 is a side elevation view of the device and object of FIG. 16 showing a fastener used to tension the wire and create a transfer mark on the transfer sheet.

Referring to FIGS. 16 and 17, in some applications with heavy or large hanging objects 42, rear mounts 44 may be coupled to a suitable bridge support such as wire 78 for ease of hanging. Wire 78 may be any suitable flexible bridge support such as, without limitation, metal or plastic wire, cord, twine or rope. For use in such applications, in template mode, the user may configure the size and placement of transfer sheet 14 in device 10 such that the front side of the transfer sheet fits between rear mounts 44 and slides in below wire 78. Alignment arrow 58 of rear base 16 may be used to assist in aligning the center or apex of wire 78 with the center of the width of object 42. The user may activate positioning members 30, 32 to ensure that alignment arrow 58 is placed at the approximate center of the width of object 42. The user may position alignment arrow 58 such that the horizontal distance measured by positioning member 30 from first side 34 to the edge of object 42 is approximately equal to the horizontal distance measured by positioning member 32 from second side 36 to the opposite edge of object 42. The user would then utilize a suitable marking member 59 as both a tensioning tool and marking tool. Marking member 59 may be positioned below a center portion of wire 78 and urged firmly back toward alignment arrow 58 and top surface 40 in order to tension the wire to a coupling position 80. Once wire 78 is secured in position, the user may utilize marking member 59 to lightly mark or puncture the rear side of transfer sheet 14 at the location aligning with coupling position 80 (for positioning the mounting location of fastener 46), creating transfer mark 60.

Through the creation of transfer marks 60 a second vertical distance 62 is formed on device 10 from ledge 38 to the centerline of transfer marks 60. As described above, second vertical distance 62 is approximately equal to first vertical distance 54. Thus, the geometrical relationship between top surface 40 and centerlines 56 is then easily directly transferred to device 10 via ledge 38 and transfer marks 60.

Figure 18:
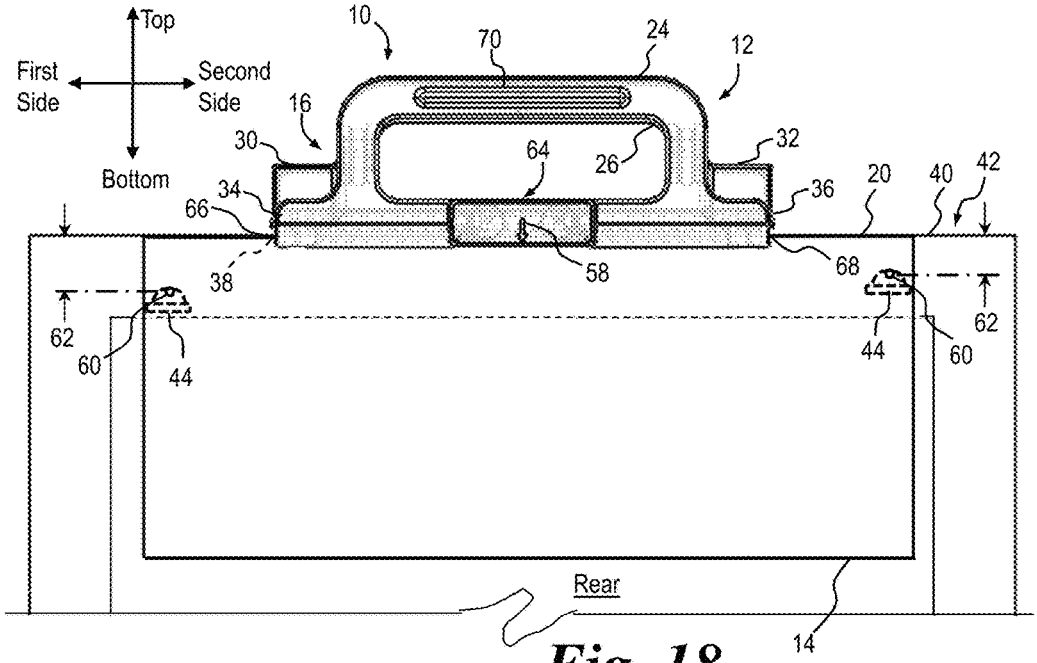
FIG. 18 is the rear view of the device of FIG. 3 used with an object having rear mounts installed at different vertical locations.

Referring to FIG. 18, for some larger objects with dual rear mounts 44, the rear mounts may have been factory installed at different vertical distances from top surface 40. This may not be readily apparent to the user as they are trying to position the fasteners for hanging such object, and can result in an unlevel installation of top surface 40. Device 10 enables the user to make accurate transfer marks 60 regardless of the locations for rear mounts 44. As a result, even if second vertical distances 62 corresponding to each of the rear mounts are not equal, the geometrical relationship required between top surface 40 and each transfer mark 60 remains accurate. As the desired visual for the user is to have top surface 40 substantially horizontally level when installed, level 28 of device 10 keeps ledge 38 maintained horizontally level so transfer marks 60 can be transferred accurately, even though they are not level with respect to each other.

Figure 19:
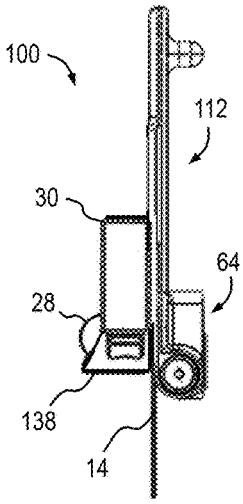
FIG. 19 is a first side partial elevation view of a device according to another embodiment of the present invention.

Referring to FIG. 19, in an alternative embodiment, a device 100 may be formed with a single piece positioning member 112, without hinge clamps 22. Device 100 may include a ledge 138 configured for selectable attachment to the bottom of the device. Such selectable attachment of ledge 138 may be made by clips, fasteners, magnets or other suitable features that provide for selectably securing transfer sheet 14 in place when ledge 138 is attached to device 100. In an alternative embodiment of device 100, ledge 138 may be stationary and the device may include a dispensing system configured to both dispense and secure a continuous roll of transfer sheet 14.

Figure 20:
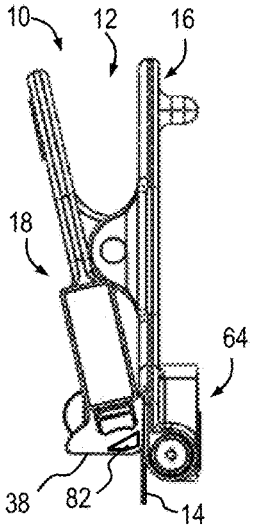
FIG. 20 is the side elevation view of a device with expansion arms according to another embodiment of the present invention.
Figure 22:
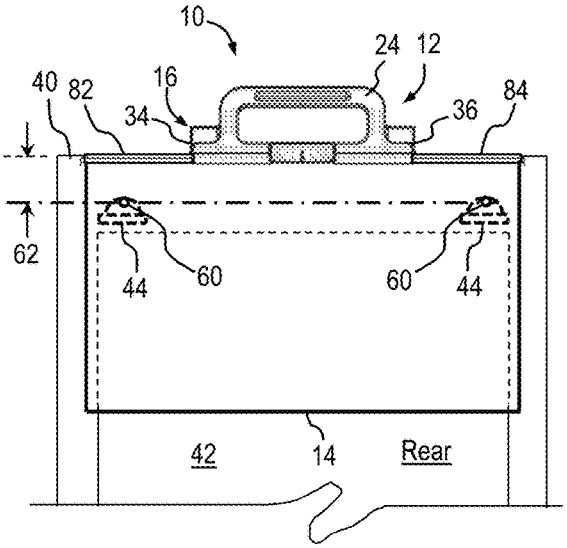
FIG. 22 is the rear view of the device of FIG. 20 shown in template mode with the expansion arms extended.
Figure 21:
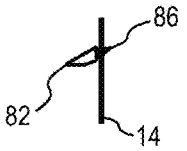
FIG. 21 shows an attachment feature of the expansion arm of FIG. 20.

Referring to FIGS. 20 through 22, in some embodiments, device 10 includes a pair of opposing expansion arms 82, 84 that are selectably extendable from the first side 34 or second side 36, respectively, to make the device wider. For example, if the device were approximately 12 inches wide, extending both expansion arms 82, 84 would give the device a 24 inch width. Expansion arms 82, 84 include attachment features 86 configured to provide selectable attachment to the adjacent front side of transfer sheet 14. Attachment features 86 may include toggle type, push button pins, where the user can urge transfer sheet 14 against the pins to puncture the transfer sheet and secure the front side of the transfer sheet 14 to expansion arms 82, 84. Although shown as pins, attachment features 86 may be any suitable feature configured to retain transfer sheet 14, such as, without limitation, clip, clamps, or selectively exposed adhesive.

Figure 23:
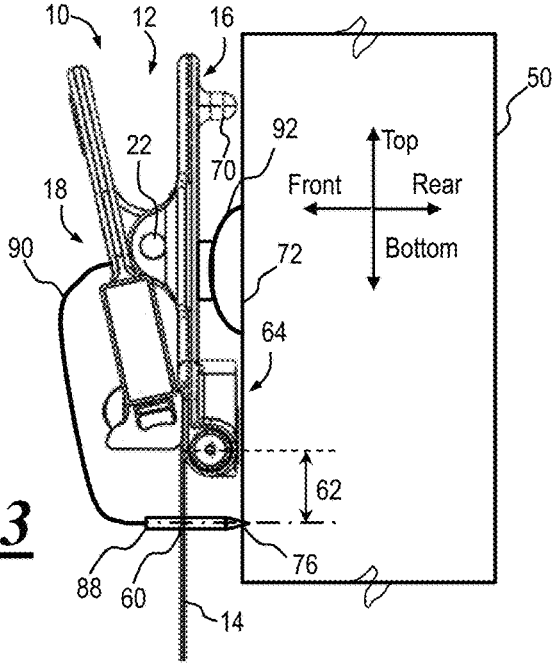
FIG. 23 is the side elevation view of a device according to another embodiment of the present invention.

Referring to FIG. 23, in some embodiments, device 10 may include a movable marking member 59 coupled to the device, such as a stylus 88. Stylus 88 may be coupled to device 10 by a retractable tether 90 or other suitable tether, such as a flexible or stretchable cord, for example. Stylus 88 may include an extendable media, such as a lead rod, that is configured to mark on the rear side or to be punctured through the rear side of transfer sheet 14 to create transfer marks 60. Stylus 88 may also be inserted through the front side of transfer sheet 14 at transfer marks 60 to create marks 76 on front surface 72 of planar structure 50.

Also referring to FIG. 23, in some embodiments, device 10 may include adhesion features 92 configured to selectably adhere rear base 16 of the device to an adjacent front surface 72 of planar structure 50. Any suitable adhesion features 92 may be used, such as suction cups or temporary adhesive. Adhesion features 92 provide stabilization to device 10 during the transfer mode to resist movement of the device while marks 76 are created.

Positioning member 12 may be made from any suitable material, such as plastic, metal or wood, for example, or combinations thereof. Positioning member 12 may be made in different sizes and material construction types for applications suited to either residential or commercial use. In some embodiments, device 10 may be devoid of either or both of level 28 or positioning systems 30, 32.

While this invention has been shown and described with respect to detailed embodiments thereof, it will be understood by those skilled in the art that changes in form and detail thereof may be made without departing from the scope of the claims of the inventions.

What is claimed is:

1. A measurement free method for preparing a pattern of the location of a hanging mount of an object to be hung on a planar surface, comprising the steps of:

obtaining a device comprising:

a positioning member and a transfer sheet, the positioning member having a ledge, the transfer sheet being releasably connectable to the positioning member proximate the ledge of the positioning member, the ledge of the positioning member configured to temporarily abut the top surface of an object, the object having at least one rear mount for hanging the object;

releasably connecting the positioning member to the transfer sheet proximate the ledge of the positioning member;

abutting the ledge of the positioning member to the top surface of the object;

creating a transfer mark at a location on the transfer sheet adjacent to the at least one rear mount of the object.

2. The method of claim 1 further comprising the steps of:

placing the positioning member adjacent to a planar structure having a front surface;

creating a mark on the front surface of the planar structure adjacent to the transfer mark of the transfer sheet;

securing a fastener to the front surface of the planar structure relative to the location of the created mark on the front surface of the planar structure;

removably attaching the at least one rear mount of the object to the secured fastener.

3. The method of claim 2 further comprising the steps of:

providing a mount support having an opening and a coupling portion, the mount support opening being offset from the coupling portion of the mount support, the coupling portion being adapted to engage the at least one rear mount of the object;

aligning the coupling portion of the mount support with the mark created on the front surface of the planar structure;

wherein the step of securing the fastener to the front surface of the planar structure relative to the location of the created mark on the front surface of the planar structure further comprises securing the mount support to the front surface of the planar structure by inserting the fastener through the mount support opening.

4. The method of claim 2 wherein the step of securing the fastener to the front surface of the planar structure relative to the location of the created mark on the front surface of the planar structure further comprises securing the fastener to the front surface of the planar structure at the location of the created mark on the front surface of the planar structure.

5. A device for preparing a pattern of the location of a hanging mount of an object, the device comprising:

a positioning member and a transfer sheet; the positioning member further comprising a front guide and a rear base rotatably coupled to the front guide by a pair of hinge clamps;

the positioning member having a ledge, the transfer sheet being releasably connectable to the positioning member proximate the ledge of the positioning member, the ledge of the positioning member configured to temporarily abut the top surface of an object, the object having at least one rear mount.

6. The device of claim 5 wherein the transfer sheet is semi-transparent and penetrable.

7. The device of claim 5 wherein the transfer sheet comprises tracing paper.

8. The device of claim 7 wherein the front guide and rear base each have generally U-shaped cooperating handle portions disposed distal to the ledge of the positioning member.

9. The device of claim 5 wherein the object comprises a framed picture.

10. The device of claim 5 further comprising a level attached to the positioning member for ascertaining horizontal positioning of the ledge of the positioning member.

11. The device of claim 10 wherein said level comprises a bubble level.

12. The device of claim 10, further comprising a laser adapted to emit a laser projection laterally for alignment purposes.

13. The device of claim 5, the front guide having a pair of opposing positioning systems attached thereto for ascertaining lateral distance.

14. The device of claim 13 wherein each of the opposing positioning systems comprises a laterally deployable and retractable tape measure.

15. The device of claim 13 wherein each of the opposing positioning systems comprises an electronic distance indicator.

16. A device for preparing a pattern of the location of a hanging mount of an object, the device comprising:

a positioning member and a transfer sheet, the positioning member having a ledge and being releasably connectable to the transfer sheet proximate the ledge;

the ledge being configured to temporarily abut a top surface of an object configured to hang on a planar structure;

the object having at least one rear mount at a predetermined first distance from the top surface of the object;

the transfer sheet being configured to accept a transfer mark at the location of the at least one rear mount when the ledge is abutted with the top surface of the object.

17. The device of claim 16, wherein the transfer sheet is penetrable such that after removal from the object an opening may be created through the transfer sheet at the location of the transfer mark to facilitate placement of a mark on the planar structure.

18. The device of claim 16, further comprising a level for horizontal positioning of the device on the planar structure.

19. The device of claim 16, further comprising a laser system for alignment of the device on the planar structure.

* * * * *